US007402954B2

(12) United States Patent
Van Den Nieuwenhuizen et al.

(10) Patent No.: US 7,402,954 B2
(45) Date of Patent: Jul. 22, 2008

(54) HIGH-PRESSURE DISCHARGE LAMP, HAVING A SEAL COMPRISING A GAS-FILLING CAVITY

(75) Inventors: Hubertus Cornelis Maria Van Den Nieuwenhuizen, Eindhoven (NL); Johan Leopold Victorina Hendrix, Eindhoven (NL); Petrus Hendrikus Antonis, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 400 days.

(21) Appl. No.: 10/539,327

(22) PCT Filed: Nov. 24, 2003

(86) PCT No.: PCT/IB03/05469

§ 371 (c)(1), (2), (4) Date: Jun. 15, 2005

(87) PCT Pub. No.: WO2004/057644

PCT Pub. Date: Jul. 8, 2004

(65) Prior Publication Data

US 2007/0052364 A1 Mar. 8, 2007

(30) Foreign Application Priority Data

Dec. 19, 2002 (EP) ..... 02080422

(51) Int. Cl.
*H01J 17/16* (2006.01)
*H01J 17/18* (2006.01)

(52) U.S. Cl. ..... 313/625; 315/344; 313/623; 313/634

(58) Field of Classification Search ..... 313/627–643, 313/567, 111–117, 25–27, 318.01–318.09, 313/623–625; 439/615, 739; 445/24, 26, 445/29, 22
See application file for complete search history.

(56) References Cited

U.S. PATENT DOCUMENTS 5,323,091 A * 6/1994 Morris ..... 315/344
6,570,328 B1 * 5/2003 Steinmann ..... 313/634

FOREIGN PATENT DOCUMENTS

| | | | |
|---|---|---|---|
| DE | 1975290U | A | 12/1967 |
| JP | 2001266794 | A | 9/2001 |
| SU | 1367066 | A1 | 1/1988 |
| WO | 0077826 | A1 | 12/2000 |
| WO | 0118847 | A1 | 3/2001 |

* cited by examiner

*Primary Examiner*—Mariceli Santiago
*Assistant Examiner*—Donald L Raleigh

(57) ABSTRACT

A high-pressure discharge lamp (1) having a quartz glass discharge vessel (2) enclosing a discharge space (3) with an ionizable filling, wherein a first electrode (4) and a second electrode (40) are present between which a discharge is maintained during lamp operation, wherein a first seal (5) incorporates a first internal electric conductor (6) which connects the first electrode (4) to a first external electric conductor (7) extending from the seal (5) into the exterior, wherein said first seal (5) further incorporates a gas-filled cavity (10), wherein the internal electric conductor (6) is a foil which extends through the cavity (10), and wherein the foil (6) is provided with at least one hole (11).

5 Claims, 4 Drawing Sheets

HIGH-PRESSURE DISCHARGE LAMP, HAVING A SEAL COMPRISING A GAS-FILLING CAVITY

The invention relates to a high-pressure discharge lamp having a quartz glass discharge vessel enclosing a discharge space with an ionizable filling, wherein a first electrode and a second electrode are present between which a discharge is maintained during lamp operation, wherein a first seal incorporates a first internal electric conductor which connects the first electrode to a first external electric conductor extending from the seal into the exterior, wherein said first seal further incorporates a gas-filled cavity, which is preferably at least partially surrounded by an external capacitive body, and wherein said first internal electric conductor is a foil which extends through the cavity.

A lamp of the type described is known from WO 00/77826. The known lamp is suitable for operation in air, i. e. free from an outer envelope. For lamps intended for an accurate formation of a beam by means of an optical system, this is an important advantageous aspect. Particularly for applications such as, for example, in projectors, and motor vehicle headlamps, the avoidance of optical disturbances caused by an outer envelope plays an important role. It is important that the temperature of the electric conductor has a relatively low value at the area where it is exposed to air, in order that a rapid oxidation of the conductor is prevented. In the known lamp, this is realized by elongating the seal. In this description and the claims, quartz glass is understood to mean a glass having an $SiO_2$ content of at least 95%.

In high-pressure discharge lamps, ignition delay often occurs in practice when igniting the lamp. The risk of an ignition delay strongly increases when the lamp has been in the dark for some time. The occurrence of ignition delay is a great drawback and, under circumstances, may lead to dangerous situations, for example, when using a high-pressure lamp as a motor vehicle headlamp.

The known lamp has the advantage that the available cavity and the metal capacitive body, constitute a start-promoting means as a source of UV radiation when applying an electric voltage across the cavity. The UV radiation source is referred to as UV enhancer. Said metal capacitive body may or may not needed to be connected to the electrode in the opposite seal, depending on the frequency at which the lamp is operated. At ultra-high frequencies said capacitive body may not be needed at all.

The foil, preferably made of ductile Molybdenum (Mo), and extending through the cavity has the important advantage that a strong concentration of an electric field is produced at the edges of the foil as soon as a voltage is applied to the conductor. This enhances breakdown in the UV enhancer. In order to raise the electric field further these foil edges are usually sharpened when the foils are produced.

A first problem that often occurs is that the sharp edges of the foil are damaged when the foil is melted into the seal of the lamp, either because of the handling of the foil itself or because they touch the wall of the cavity through which they extend. Thereby said breakdown in the UV enhancer is not always as low as expected. Another problem with said foils is that they can divide the cavity into two separate compartments. Although the cavities are designed such that there is a gap between the edges of the foil and the wall of the cavity, in some cases the seal is not formed with a cavity having proper dimensions and the foil is touching the wall along both it sides. Thereby not only the breakdown properties of the UV enhancer are greatly reduced because of the absence of sharp edges, but also the compartments are often of unequal dimensions, whereby the minimum breakdown voltage in both compartments are unequal as well.

It is an object of the invention to provide a accurate and reliable lamp, which is easy and efficient to produce, wherein the aforementioned drawbacks are alleviated.

According to the invention, a high-pressure discharge lamp of the type described in the opening paragraph is characterized in that the foil is provided with at least one hole. By providing one or more holes, whether in the central part or near the edge of the foil, the existence of a sharp edge on the foil in the cavity can be guaranteed, and also formation of two separate compartments in the cavity is prevented. Also a pattern of holes can be formed in the foil.

The hole in the foil may be of any form, for instance an elongated slot, but simply punching the foil with a needle has proven to be sufficient. Thereby a crater-like hole is formed in the foil, the wall of which crater extends into one half of the cavity. Using this method, also the edges of the hole will be sharp without the need to sharpen them separately.

Preferably, the gaseous constituent of the filling in the cavity comprises mercury vapor. This has the advantage that relatively much UV radiation is generated by the UV enhancer, which particularly contributes to a rapid and reliable hot ignition. A further advantage of the lamp according to the invention is that no separate mercury dosage appears to be necessary. This is easily realizable by making the first seal after the discharge vessel has been provided with its filling. For the purpose of electrical connection of the second electrode, the lamp is provided with a second seal for feedthrough of an electric conductor to the second electrode. For reasons of an efficient production of the lamp according to the invention, this second seal has preferably the same construction as the first seal.

The invention furthermore relates to a method for producing a high-pressure discharge lamp wherein a quartz glass discharge vessel enclosing a discharge space is filled with an ionizable filling, wherein a first electrode and a second electrode are placed such that a discharge can be maintained during lamp operation, wherein a first seal is provided with a first internal electric conductor being a foil which connects the first electrode to a first external electric conductor extending from the seal into the exterior, wherein said first seal is further provided with a gas-filled cavity through which the foil extends, and wherein the foil is provided with at least one hole.

Preferably the hole is provided in the foil by punching the foil with a needle.

These and other aspects of the invention are apparent from and will be elucidated with reference to the embodiments described hereinafter.

Figure 1:
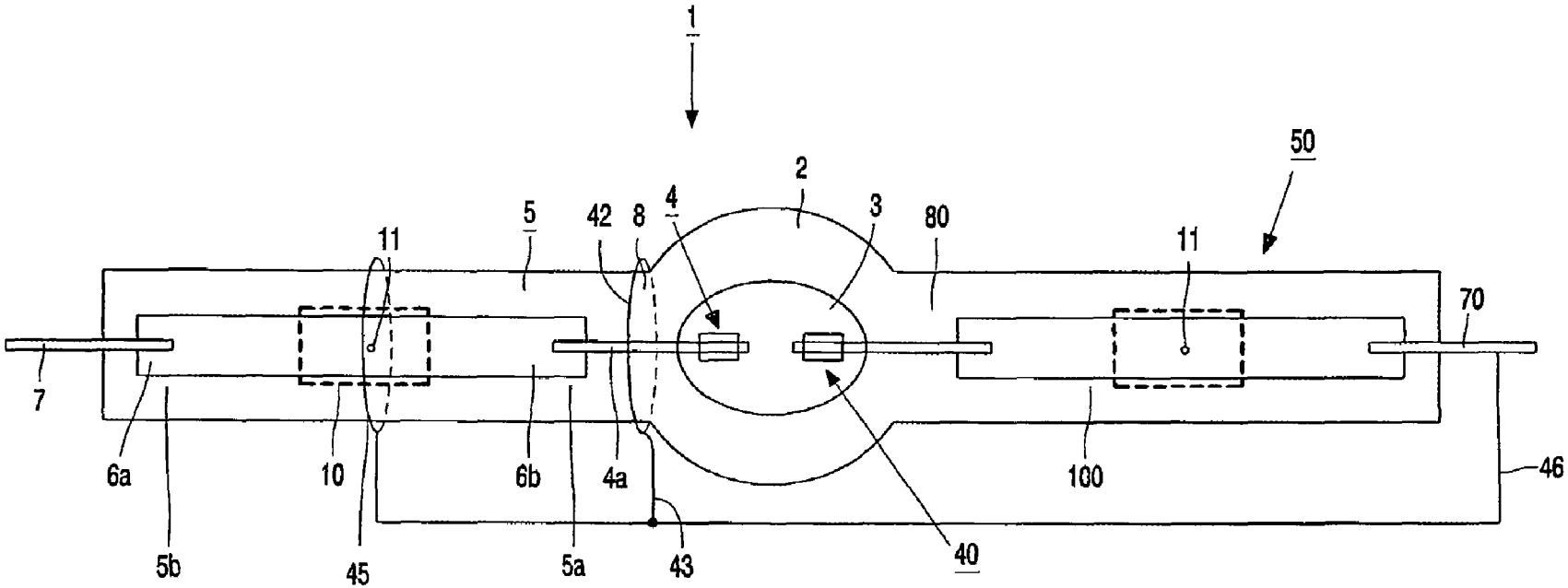
FIG. 1 shows a lamp, comprising a collapsed seal.

FIG. 1 (not to scale) shows a high-pressure discharge lamp 1 provided with a glass discharge vessel 2 which encloses a discharge space 3 with an ionizable filling, in which a first electrode 4 and a second electrode 40 are present, between which a discharge extends during lamp operation, and having a first seal 5 incorporating an electric conductor 6 in the form of a foil which connects the first electrode 4 to a metal wire 7 projecting to the exterior from the first seal, which first seal has a first gas tight portion 5*a* and a second gas tight portion 5*b* between which a gas-filled cavity 10 is present, The cavity comprises at least a gaseous constituent of the filling. For example, the cavity comprises mercury vapor.

At the area of the cavity, the first seal has a first external capacitive body 45. The first seal is connected to the discharge vessel at the area of a neck 8. At the area of the neck, a second external capacitive body 42 is present which is electrically connected to the first external capacitive body by means of a conductor 43.

The first seal 5 constitutes a collapsed seal. The foil 6 is an Mo strip having knife edges and a hole 11. Said hole is produced by punching the foil with a needle at the time of assembly of the metal parts of the lamp. The metal wire 7 is secured to one end 6*a* of the strip, for example, by welding and projects to the exterior from the seal and from the discharge vessel. An electrode rod 4*a* of the first electrode 4 is secured to a further end 6*b* of the strip 6. On the side facing the first electrode 4, the discharge vessel of the second electrode 40 and a second seal 50, with a cavity 100 and a neck 80, has a comparable construction. The second electrode is connected to a wire 70. In the operating condition of the lamp, a discharge extends between the electrodes. In the embodiment described, the first and the second external capacitive body 45, 42 are electrically connected to the second electrode 40 by means of a conductor 46. Thus a passive serial capacitive body is realized.

Figure 2A:
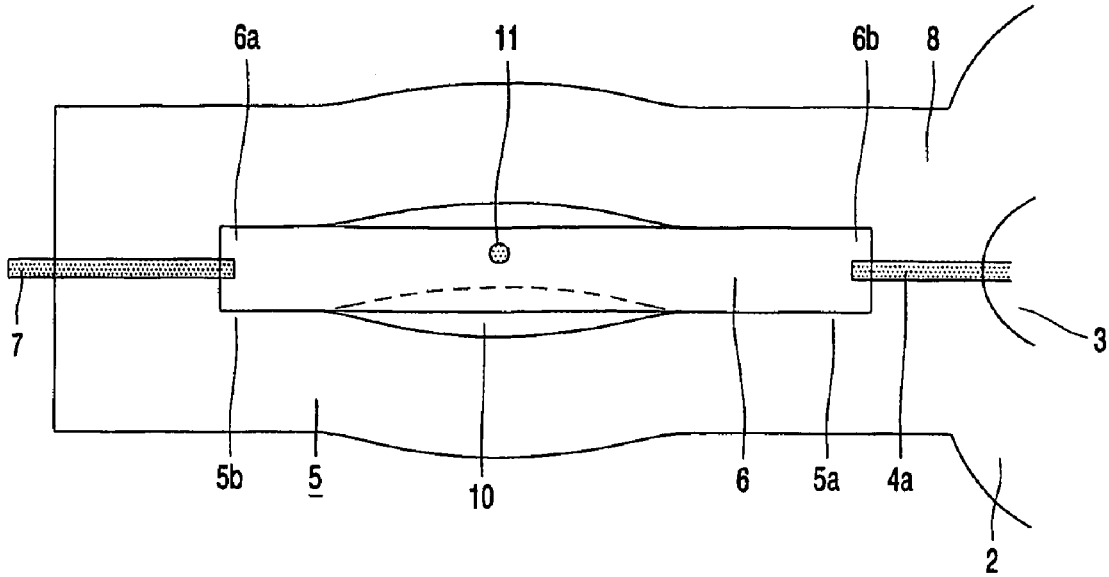
FIG. 2 shows the collapsed seal of FIG. 1 in detail.
Figure 2B:
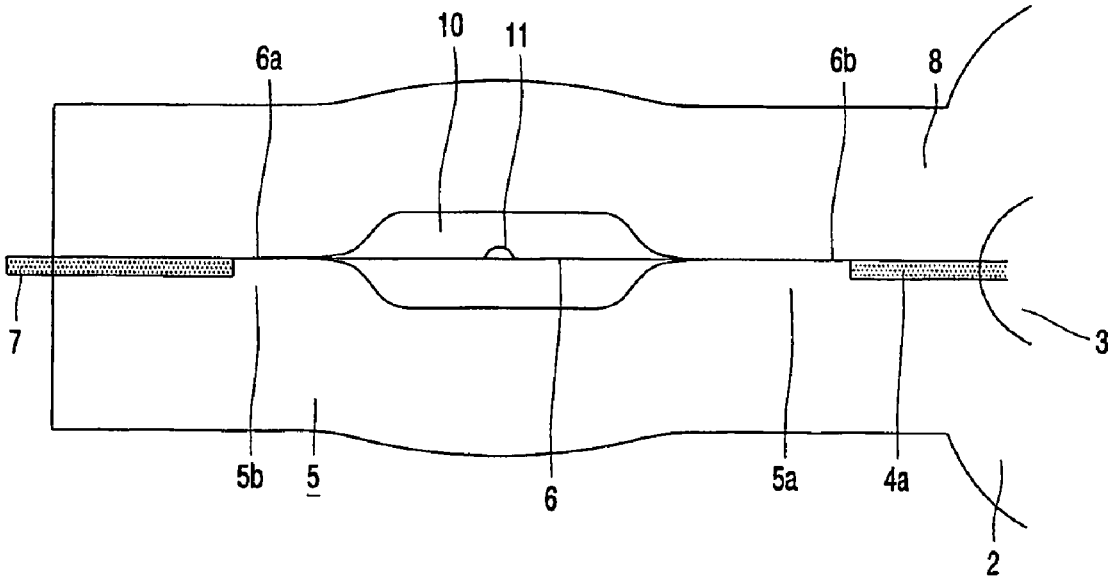

FIG. 2 (not to scale) shows the first collapsed seal of the lamp of FIG. 1 in detail, in which FIG. 2A shows the first seal with a punched strip 6 in a plan view and FIG. 2B shows it with strip 6 in a side elevation. In FIG. 2, the capacitive bodies 45 and 43 are not shown for the sake of clarity.

Figure 3:
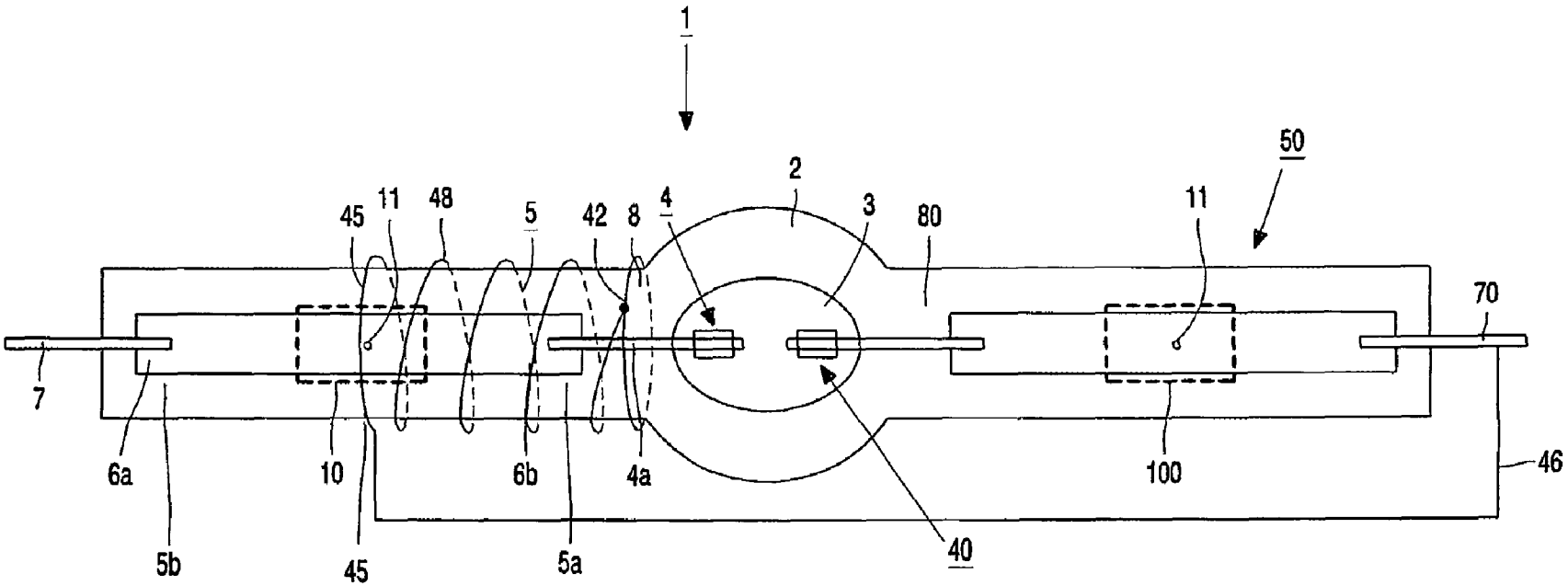
FIG. 3 shows an embodiment of the lamp.

In a first embodiment of the lamp according to the invention, shown in FIG. 3, the first capacitive body 45 is an electrically isolated first wire loop of an electrically isolated wire 48 at the area of the cavity 10, which is wound with some turns around the first seal 5 as far as the neck 8 where it forms the capacitive body 42. This embodiment is advantageous because of the possibility of a simple construction of the capacitive bodies 45 and 42, formed from a single wire. Because the lamp operates at a frequency of for instance 150 kHz between the electrodes, a connecting conductor 46 between the capacitive bodies 45 and 42 and electrode 40 is necessary for applying the necessary voltage across the cavity 10.

Figure 4:
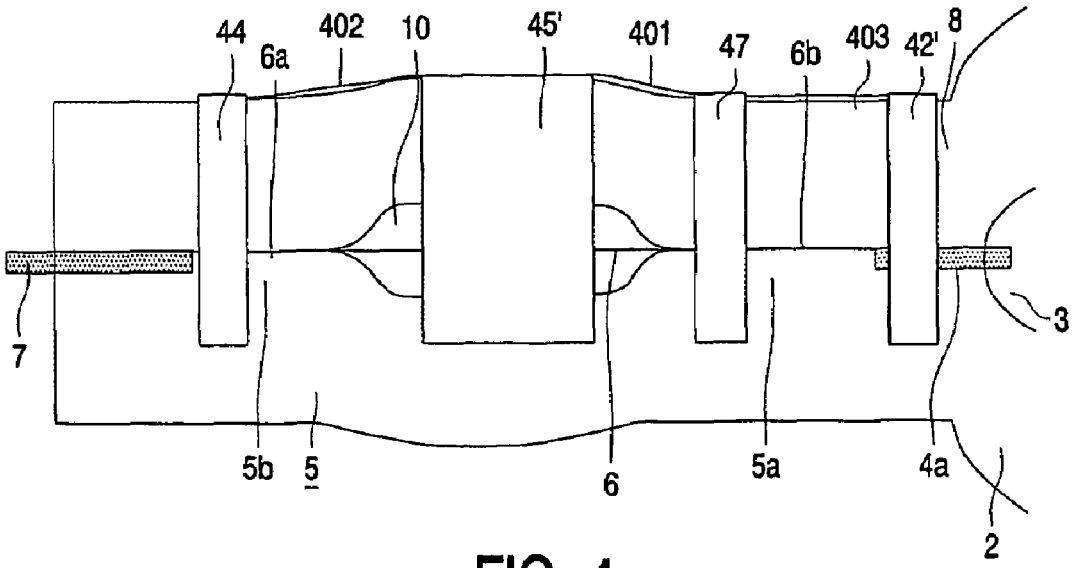
FIG. 4 shows a seal provided with a resilient clamp body.
Figure 5:
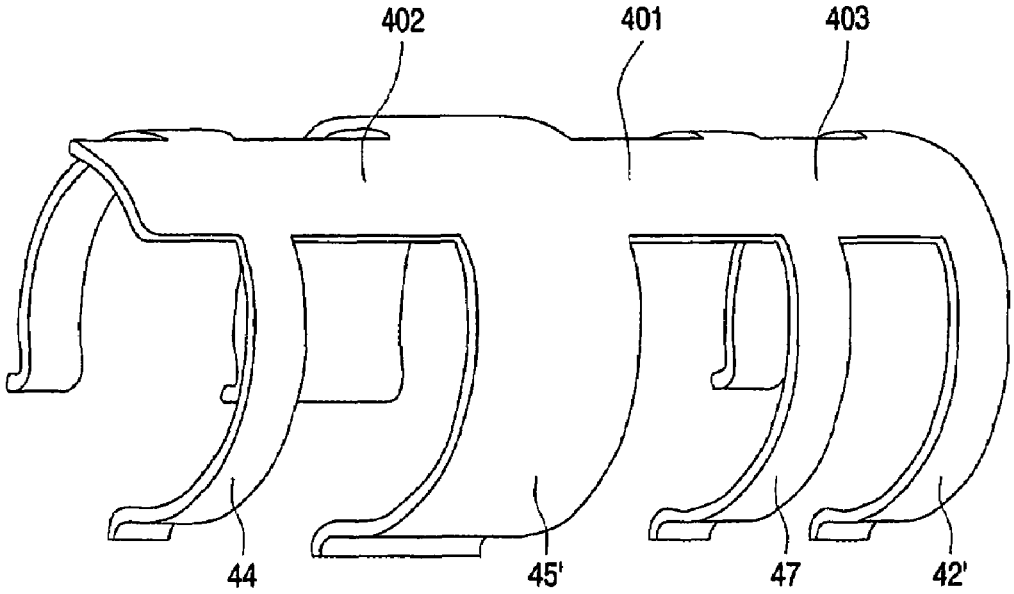
FIG. 5 shows a side view of the resilient clamp body.

In an advantageous embodiment of the lamp, the capacitive bodies are formed as resilient clamp bodies. FIG. 4 shows (not true to scale) how the first seal is provided with such capacitive bodies. In the embodiment shown, the first seal, which has a substantially round circumference, is clamped by four resilient clamp bodies. A first resilient clamp body 45' located at the cavity forms the first capacitive body and a second resilient clamp body 42' located at the neck 8 forms the second capacitive body. A third resilient clamp body 44 is located close to the second gas tight portion 5*a* of the first seal. A fourth resilient clamp body 47 is provided in between the resilient clamp bodies 45' and 42'. The resilient clamp bodies 44, 42', 45', 47 are interconnected by connection bodies 401, 402, 403. Due to the presence of the cavity 10, the circumference of the first seal is somewhat larger at the cavity than on either side thereof. Preferably the fourth resilient clamp body is located immediately beside the larger circumference. The shown configuration has the advantage that the position of the first capacitive body 45' is substantially fixed in this way due to the differences in the circumference. A further advantage is that the capacitive bodies can be produced as separate lamp parts and can be mounted on the lamp in a simple way afterwards. Preferably, the resilient clamp bodies and the connection bodies are made in one piece. FIG. 5 shows a side view of the resilient clamp bodies 44, 45', 42', 47 and connection bodies 401, 402, 403 made in one piece.

In a practical realization of the lamp in accordance with the embodiment shown, the lamp is a high-pressure mercury discharge lamp having a nominal power of 120 W, which can be extended to at least 250 W. The lamp, which is intended for projection purposes, has a discharge vessel with an internal diameter of 4 mm and an electrode distance of 1 mm. The discharge vessel has an ionizable filling which, in addition to mercury and a rare gas, for example, argon having a filling pressure of 100 mbar, also comprises bromine. During operation of the lamp, a pressure of 160 bar or more prevails in the discharge vessel. The discharge vessel is made of quartz glass having a largest thickness of 2.5 mm. The knife-edged and punched strip is an Mo strip to which a metal wire is secured at one end. An electrode rod of a first electrode is secured to the other end of the strip. The lamp is provided on each side with a collapsed seal each having a length of 28 mm. A length of 5 mm of the collapsed seal is already adequate for hermetically sealing the discharge vessel. The remaining length of the collapsed seal is used to give the temperature of the electric conductor a sufficiently low value at the area where it is exposed to air. Each collapsed seal has a cavity. Each collapsed seal has a length of 7 mm between the discharge space and the relevant cavity. Each cavity has a length of 5 mm.

The first seal is provided with a first capacitive body at the area of the cavity, in the form of a wire winding which extends in 2 to 3 turns as far the neck between the seal and the discharge vessel, where it forms a second capacitive body in a closed winding. The second capacitive body is spaced apart from the discharge space through a distance of between 1 mm and 3 mm. The wire has a diameter of 0.5 mm.

In a further practical realization the first seal is provided with four resilient clamp bodies made of an electrically conductive, heat-resistant material, in the described case stainless steel RVS310. The resilient clamp body located at the cavity has a width of 3 mm. The other resilient clamp bodies each have a width of 1 mm. The resilient clamp bodies are interconnected by connection bodies having a width of 2 mm. The resilient clamp bodies and the connection bodies are made from one piece of material.

The lamp manufacture starts from a quartz glass tube in which a vessel is formed which is provided with tubular parts at two diametrically opposed locations, which tubular parts will serve for the manufacture of seals. First, a seal is made on the lamp vessel, for example a collapsed seal after a knife-edged and punched strip and a conductor and electrode secured thereto in known manner have been provided, which collapsed seal is realized by heating the relevant tubular part in such a way that it softens and flows out under the influence of a prevailing sub-atmospheric pressure. This is preferably done by means of a laser beam rotating with respect to the tubular part, which rotating beam is moved from the conductor towards the electrode rod. By interrupting the laser beam at the location of the strip for some time, a gas tight cavity is realized. The cavity thus formed comprises a gas which is present in the tubular part and the discharge space during manufacture of the collapsed seal. This is generally a rare gas with which the quartz glass tube is rinsed during manufacture of the seal.

For reasons of an efficient manufacture, the rare gas which will form part of the filling of the discharge vessel will preferably be used for this purpose. Subsequently, the discharge vessel is provided with the constituents required for the filling, whereafter a knife-edged strip with secured electrode and ditto conductor is provided at the area of the other tubular part.

Subsequently, a collapsed seal is made in a corresponding manner also in the other tubular part by heating and consequent flowing of the tubular part. The cavity thus formed is thus also automatically filled with vapor of the filling present in the discharge vessel, particularly mercury vapor. This is a great advantage for a satisfactory start-enhancing operation. It has been found that the collapsed seals thus formed qualitatively constitute equally good seals as in the case where the collapsed seals do not have a gas tight cavity.

A practical lamp of the type described above requires a voltage of 1 kV for cold ignition, for example a voltage in the form of a high-frequency signal during 1 to 3 ms of, for example, 50 kHz for generating a breakdown in the cavity whereafter substantially instantaneously a discharge is produced in the discharge vessel between the electrodes, which will subsequently develop to a stable discharge arc so that the lamp operates in a stable manner. The lamp reaches its stable operating state after not more than 1 minute. In the same practical lamp, a maximum strike delay occurs after extinction of the lamp upon hot restrike of the lamp by means of a high-frequency signal of 5 kV of at most 60 s, with the power supplied during hot restrike to the lamp remaining limited to 120 W.

In the case of a comparable lamp without a cavity in one of the seals, the required ignition voltage is 20 kV under otherwise equal conditions.

The invention claimed is:

1. A high-pressure discharge lamp having a quartz glass discharge vessel enclosing a discharge space with an ionizable filling, wherein a first electrode and a second electrode are present between which a discharge is maintained during lamp operation, wherein a first seal incorporates a first internal electric conductor which connects the first electrode to a first external electric conductor extending from the seal into the exterior, wherein said first seal further incorporates a gas-filled cavity, wherein the internal electric conductor is a foil which extends through the cavity, characterized in that the foil is provided with at least one hole having a sharp edge spaced from each wall of the cavity.

2. A high-pressure discharge lamp according to claim 1, characterized in that the cavity is at least partially surrounded by an external capacitive body.

3. A high-pressure discharge lamp according to claim 1, characterized in that said foil is made of molybdenum.

4. A method for producing a high-pressure discharge lamp wherein a quartz glass discharge vessel enclosing a discharge space is filled with an ionizable filling, wherein a first electrode and a second electrode are placed such that a discharge can be maintained during lamp operation, wherein a first seal is provided with a first internal electric conductor being a foil which connects the first electrode to a first external electric conductor extending from the seal into the exterior, wherein said first seal is further provided with a gas-filled cavity through which the foil extends, and wherein the foil is provided with at least one hole having a sharp edge spaced from each wall of the cavity.

5. A method according to claim 4, characterized in that the hole is provided by punching the foil with a needle.

* * * * *